US005299640A

United States Patent [19]

Streich et al.

[11] Patent Number: 5,299,640

[45] Date of Patent: Apr. 5, 1994

[54] KNIFE GATE VALVE STAGE CEMENTER

[75] Inventors: Steven G. Streich; John T. Brandell; Charles F. VanBerg, all of Duncan, Okla.

[73] Assignee: Halliburton Company, Duncan, Okla.

[21] Appl. No.: 963,952

[22] Filed: Oct. 19, 1992

[51] Int. Cl.[5] ..... E21B 34/00

[52] U.S. Cl. ..... 166/327; 166/332

[58] Field of Search ..... 166/327, 332-334, 166/316, 386, 387

[56] References Cited

U.S. PATENT DOCUMENTS

| | | | |
|---|---|---|---|
| 2,169,568 | 8/1939 | Morrisett | 166/1 |
| 2,379,800 | 7/1945 | Hare | 175/356 |
| 2,435,016 | 1/1948 | Pitts | 166/1 |
| 3,223,160 | 12/1965 | Baker | 166/27 |
| 3,273,650 | 9/1966 | Alexandria et al. | 166/327 |
| 3,768,556 | 10/1973 | Baker | 166/154 |
| 3,811,500 | 5/1974 | Morrisett et al. | 166/154 |
| 3,873,362 | 3/1975 | Mihram et al. | 134/3 |
| 3,906,435 | 9/1975 | Lamel et al. | 340/18 |
| 3,948,322 | 4/1976 | Baker | 166/289 |
| 3,964,556 | 6/1976 | Gearhart et al. | 175/45 |
| 4,087,781 | 5/1978 | Grossi et al. | 340/18 |
| 4,160,970 | 7/1979 | Nicolson | 340/18 |
| 4,246,968 | 1/1981 | Jessup et al. | 166/334 |
| 4,387,372 | 6/1983 | Smith et al. | 340/854 |
| 4,421,165 | 12/1983 | Szarka | 166/151 |
| 4,468,665 | 8/1984 | Thawley et al. | 340/856 |
| 4,496,174 | 1/1985 | McDonald et al. | 285/53 |
| 4,578,675 | 3/1986 | MacLoed | 340/855 |
| 4,616,702 | 10/1986 | Hanson et al. | 166/65.1 |
| 4,617,960 | 10/1986 | More | 137/554 |
| 4,630,243 | 12/1986 | MacLeod | 367/82 |
| 4,724,434 | 2/1988 | Hanson et al. | 340/857 |
| 4,770,034 | 9/1988 | Titchener et al. | 73/151 |
| 4,785,247 | 11/1988 | Meador et al. | 324/338 |
| 4,796,699 | 1/1989 | Upchurch | 166/250 |
| 4,856,595 | 8/1989 | Upchurch | 166/374 |
| 4,896,722 | 1/1990 | Upchurch | 166/250 |
| 4,915,168 | 4/1990 | Upchurch | 166/250 |
| 4,928,772 | 5/1990 | Hopmann | 166/332 X |
| 4,971,160 | 11/1990 | Upchurch | 175/4.54 |
| 5,050,675 | 9/1991 | Upchurch | 166/250 |
| 5,117,910 | 6/1992 | Brandell et al. | 166/291 |
| 5,156,220 | 10/1992 | Forehand et al. | 166/332 X |

*Primary Examiner*—Thuy M. Bui

*Attorney, Agent, or Firm*—James R. Duzan; Shawn Hunter

[57] ABSTRACT

Methods and apparatus are described which permit stage cementing within a well bore by means of a well tool which includes a cementer having cementing ports which may be responsively opened and closed by means of a knife gate valve. The knife gate valve is disposed within the housing between outer and inner cylindrical walls and being slidable therein between an open position, wherein the cementing port is open and fluid may be communicated therethrough, and a closed position, wherein the cementing port is closed thus blocking fluid communication through said port. The knife gate valve is further operationally associated with a driver assembly and trigger device adapted to receive a trigger signal and actuate the driver assembly in response thereto. In alternate exemplary embodiments, the trigger signal may comprise an acoustical, magnetic, electromagnetic wave, electrical or other suitable signal which is received by the trigger device. The driver assembly may comprise a hydraulic or pneumatic arrangement or a suitable electric motor arrangement.

20 Claims, 3 Drawing Sheets

KNIFE GATE VALVE STAGE CEMENTER

BACKGROUND OF THE INVENTION

1. Field of the Invention

The present invention relates generally to methods and apparatus for use in well completion operations. More particularly, the invention relates to methods and apparatus for use in stage cementing a well bore.

2. Related Art

Cementing operations within well boreholes typically involve mixing a cement and water slurry and pumping the slurry down steel casing to particular points located in the borehole's annulus around the casing, in the open hole below, or in fractured formations. Multiple stage cementing has been developed to permit the annulus to be cemented in stages from the bottom of the well working upward. In multiple stage cementing, a cementer having cement ports is positioned proximate sections of casing or joints to be cemented within the borehole. Cement slurry is flowed through the bottom of the casing and up the annulus to the level of the cementer, thus closing off the bottom. Valves in the cementer are opened and cement slurry is then flowed through the cementer to a point further up the annulus. Stage cementing can be accomplished by employing such valved cementers at successive stages within the borehole.

Well tools which have been used for multiple stage cementing typically control the opening and closing of the cementer ports using sliding sleeves internally disposed within the housing of the well tool. Typically, two such sleeves are used, each of which is shear-pinned into an initially upper position such that the cementing ports of the tool are closed. It is common to open the cementing ports by use of a plug which is placed within the borehole and flowed down the casing until it is seated on the lower of the two sleeves. Fluid pressure within the casing is increased above the plug until the shear-pins holding the lower sleeve are sheared and the lower sleeve is moved downward to uncover the cementing ports. When a desired amount of cement has been released through the cementing ports these ports are closed by flowing a second plug down through the casing behind the cement until it is seated on the upper sleeve. Fluid pressure is increased within the casing behind the second plug until the shear-pins holding the upper sleeve are severed and the upper sleeve is moved down to close the cementing ports.

Unfortunately, a variety of problems can be encountered in the present method for opening and closing cementing ports. Occasionally, opening and closing the ports is extremely difficult since the sliding sleeves become clogged with cement or debris. Following the cementing operations, both the plugs and sliding sleeves must be removed from the tool by drilling them out. Since the plugs have been strongly pressured against the sliding sleeves, this drilling operation entails a significant degree of time and expense. It would be desirable, then, to provide a reliable means of opening and closing cementing ports which avoids the problems associated with the traditional plug and sliding sleeve arrangement.

SUMMARY OF THE INVENTION

Methods and apparatus are described which permit stage cementing within a well bore by means of a well tool which includes a cementer having cementing ports which may be responsively opened and closed by means of a knife gate valve. The knife gate valve is disposed within the housing being located between outer and inner cylindrical walls. It is slidable therein between an open position, wherein the cementing port is open and fluid may be communicated therethrough, and a closed position, wherein the cementing port is closed thus blocking fluid communication through said port. The knife gate valve is further operationally associated with a driver assembly and trigger device adapted to receive a trigger signal and actuate the driver assembly in response thereto. The driver assembly may comprise a hydraulic or pneumatic arrangement or a suitable electric motor arrangement. In alternative exemplary embodiments, the trigger signal may comprise a variety of acoustical, magnetic, electromagnetic or other suitable signals which are received by the trigger device. Applications are also described for use of the invention for multiple stage cementing operation using two or more cementers locatable at different depths in a borehole.

DETAILED DESCRIPTION OF THE PREFERRED EMBODIMENTS

Figure 1A:
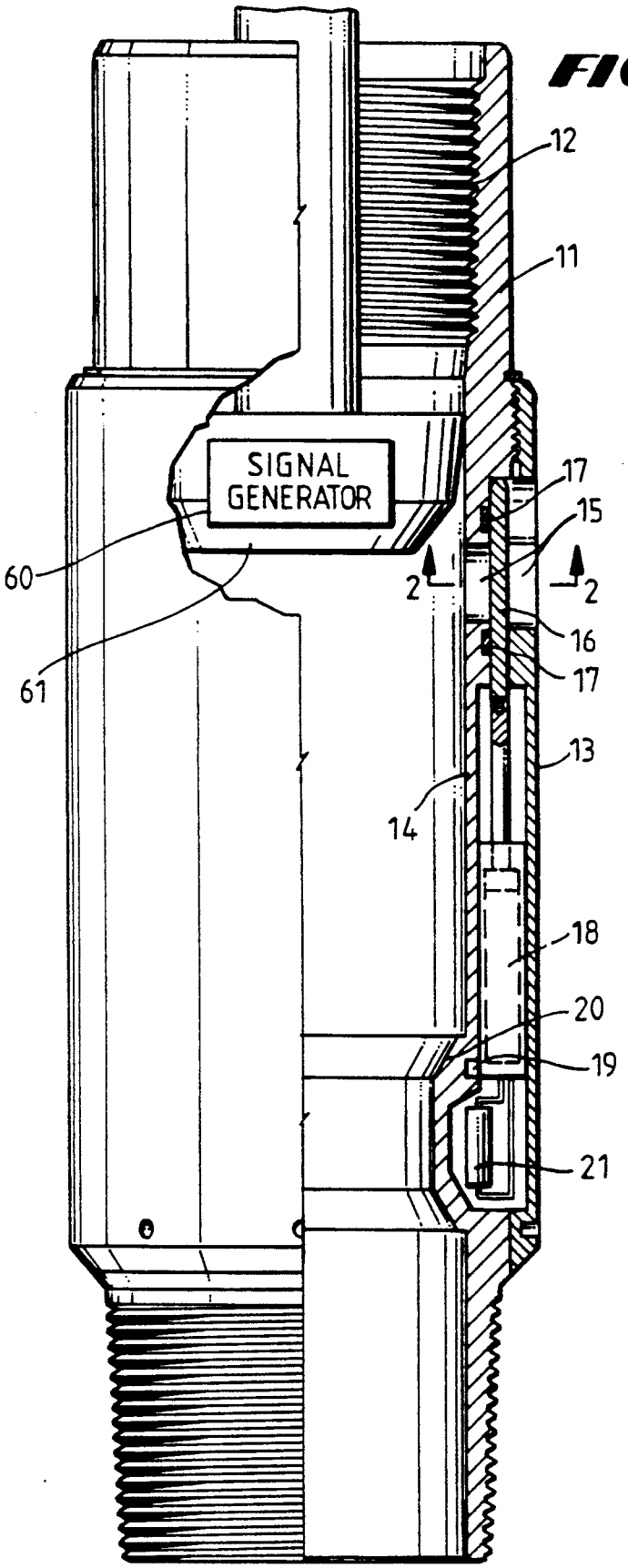
FIG. 1A is a partial cross-sectional side view of a well tool constructed in accordance with the present invention.
Figure 1B:
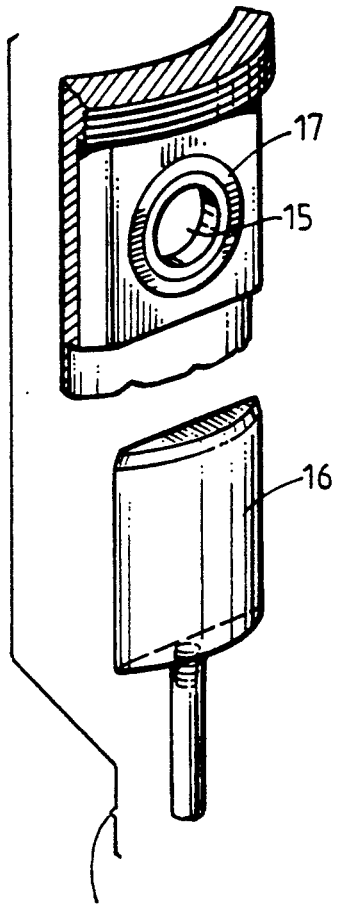
FIG. 1B is an exploded detail of a portion of the well tool of FIG. 1A.

Referring to FIG. 1A, a well tool 10 is shown which is useful for stage cementing operations within a well bore and whose construction and operation is similar to that described in greater detail in U.S. Pat. No. 3,768,556 to Baker (and assigned to Halliburton Company), which is incorporated herein by reference. The well tool comprises a generally cylindrical housing 11 defining a central passageway 12 therethrough. Portions of housing 11 further feature an outer cylindrical wall 13 and an inner cylindrical wall 14. At least one cementing port 15 is disposed within housing 11 and, unblocked, permits communication of a fluid such as a slurry through outer and inner cylindrical walls 13 and 14.

A knife gate valve 16 is disposed within the housing between the outer and inner cylindrical walls 13 and 14 and is slidable therein. The knife gate valve 16 is slidable between an open position, wherein the cementing port 15 is open and fluid may be communicated therethrough, and a closed position, wherein cementing port 15 is closed, thus blocking fluid communication through said port.

Figure 2A:
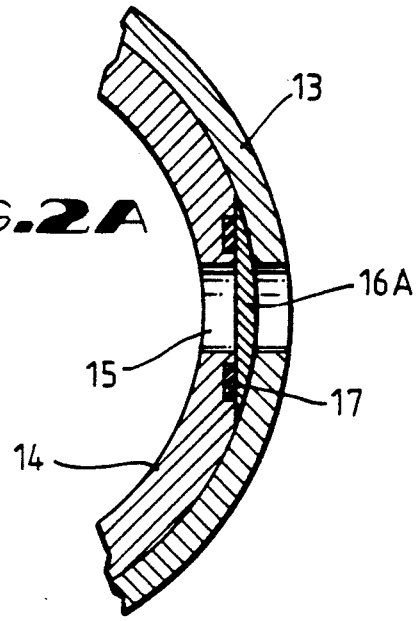
FIGS. 2A and 2B illustrate exemplary designs for the knife gate valve of the present invention.
Figure 2B:
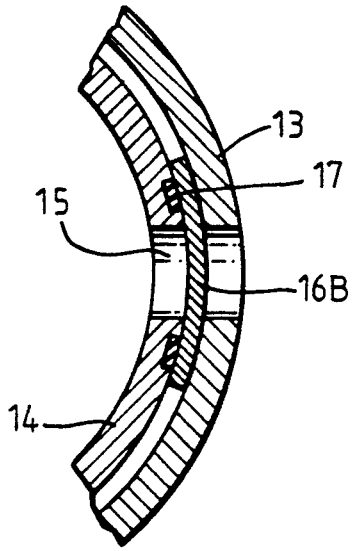

Exemplary designs for the shape of the knife gate valve are shown in FIGS. 2A and 2B. Referring now to FIG. 2A, a knife gate valve 16A is shown disposed between the inner and outer cylindrical walls 13 and 14 and presenting a substantially flat internal surface toward the inner cylindrical wall of housing 11. FIG. 2B portrays an alternative embodiment of the knife gate valve wherein exemplary knife gate valve 16B presents an internal surface which is radially curved to substantially conform against the curved surface of the inner cylindrical wall 14. It is proposed that either design will provide for an adequate seal across the cementing port when the knife gate valve is in its closed position.

A seal fitting 17 is used in preferred embodiments to assist the knife gate valve 16 in providing a fluid seal across the cementing port 15 when the knife gate valve 16 is in a closed position. The seal fitting 17 is preferably placed proximate the periphery of cementing port 15 and upon the inner cylindrical wall 14.

A driver assembly 18 is operationally associated with the knife gate valve 16 such that the driver assembly is capable of moving the knife gate valve between its open position and its closed position. In exemplary embodiments illustrated by FIG. 4, the driver assembly may comprise a pneumatic or hydraulic device which is capable of moving the knife gate valve 16 between its two positions. In these embodiments, driver assembly 18 comprises a hydraulic or pneumatic cylinder 30 within which the knife gate valve 16 is moved by means of fluid forces between its opened and closed positions. Suitable cylinders of these types are available commercially from sources such as Fluid Components, Inc. of 6526 East 40th Street, Tulsa, Okla. 74147.

The cylinder 30 is operationally associated by means of fluid tubes 31 and 32 with a fluid chamber 33 which contains a pressurized fluid. Fluid within fluid chamber 33 may be transmitted to cylinder 30 by flowing along tubes 31 and 32. Fluid flow along the tubes 31 and 32 is controlled by solenoid valves 34 and 35, respectively, which are in turn opened and closed by means of a trigger device 19 whose operation will be described separately. When solenoid valve 34 is opened by trigger device 19, fluid flow is permitted from fluid chamber 33 along tube 31 and into portions of cylinder 30 such that knife gate valve 16 is moved into an open position. When solenoid valve 35 is opened by trigger device 19, fluid flow is permitted from fluid chamber 33 along tube 32 and into portions of cylinder 30 such that knife gate valve 16 is moved into a closed position.

Figure 3:
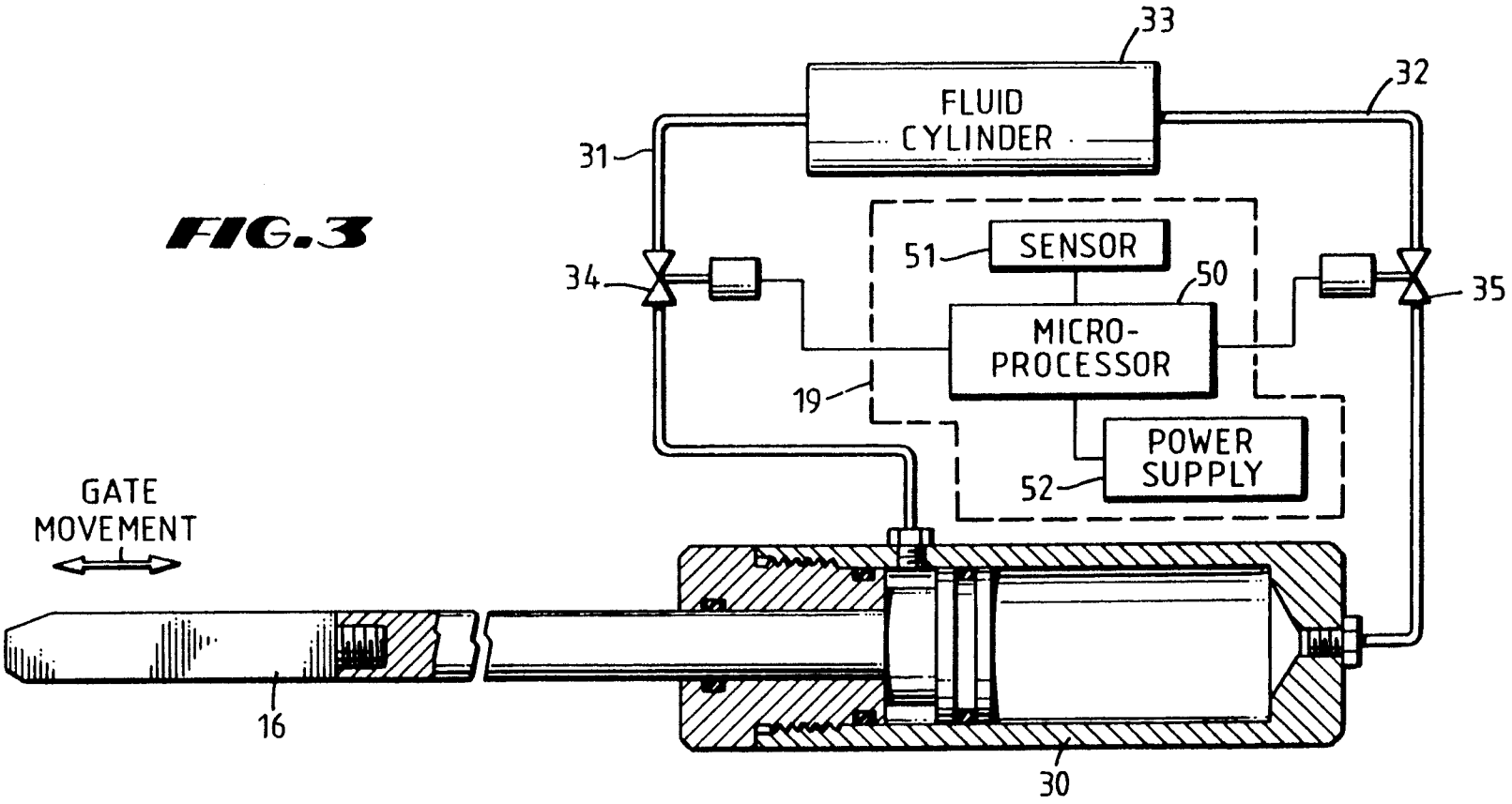
FIG. 3 is a schematic for an exemplary well tool design employing a driver assembly comprising an electric motor arrangement.

In an alternative exemplary embodiment illustrated by FIG. 3, the driver assembly 18 comprises a suitable electric motor 40 having appropriate circuitry connections with the knife gate valve 16 to move the valve between its opened and closed positions. Motor 40 is in turn controlled by a trigger device 19.

Figure 4:
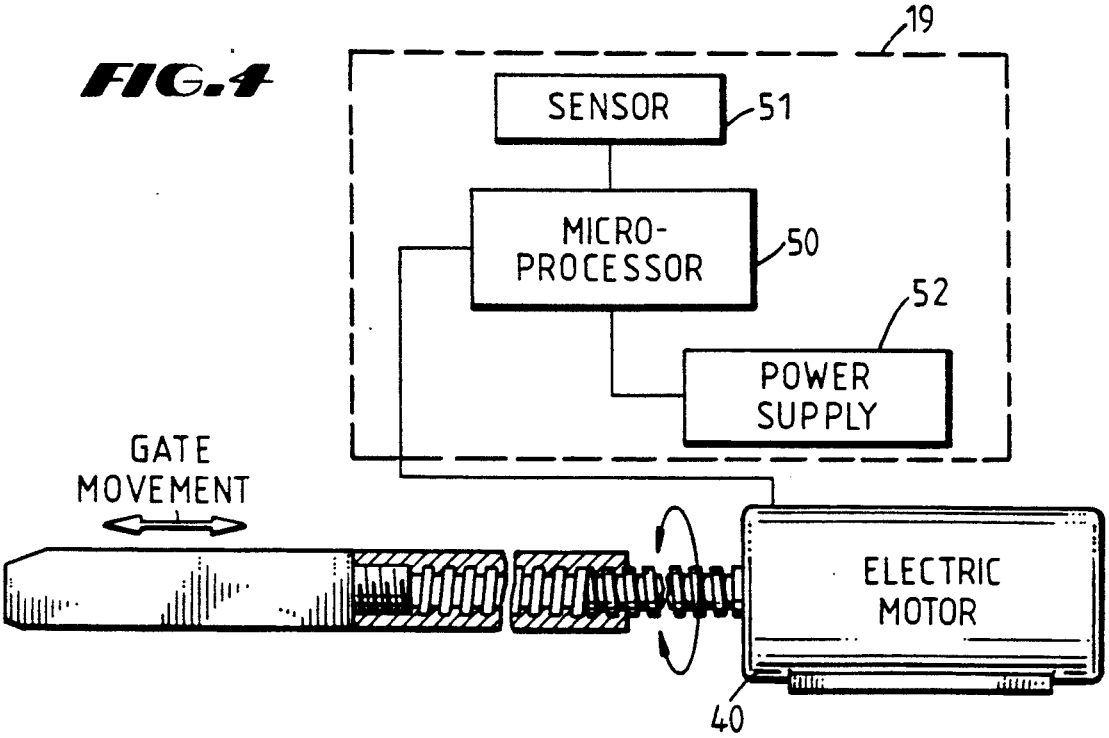
FIG. 4 is a schematic for an exemplary well tool design employing a driver assembly comprising a hydraulic or pneumatic arrangement.

Trigger device 19 is operationally associated with the driver assembly 18 so as to actuate the drive assembly 18 in response to appropriate trigger signals. As illustrated in FIGS. 3 and 4, the trigger device 19 preferably comprises a microprocessor 50 or other logic gate with an associated sensor 51 for receiving trigger signals as input. The trigger device 19 also comprises an appropriate power supply 52 for operation of the microprocessor 50 and its associated sensor 51. The sensor 51 will be a magnetic sensor, pressure or acoustical sensor as dictated by the particular form of trigger signal the trigger device 19 will receive.

The trigger signals may comprise any suitable type of signal including acoustical, electromagnetic wave, electrical pulse, pressure or magnetic signals. In one preferred embodiment the trigger signals are provided by a signal generator 60 which is disposed within a borehole plug of the type which is typically disposed into the central passageway of a well tool. FIG. 1A shows exemplary plug 61 to illustrate a suggested placement. The signal generator 60 may comprise any of a number of well known devices adapted to provide a suitable signal to the trigger device, for instance a sound generator for creation of acoustical signals. In a highly preferred embodiment, signal generator 60 comprises a strong permanent magnet to provide a magnetic signal to function as a trigger signal to the trigger device. Alternatively, the pressure against the plug seat provided by the seating of the plug can serve as a signal to the trigger device.

As a result of the preferable arrangement of parts described above, a number of arrangements are possible for insuring that the trigger signals are provided to the trigger device 19 at an appropriate time to effect opening or closing of the knife gate valve 16. An exemplary arrangement is shown in FIG. 1A wherein the trigger device 19 is located within a plug seat 20 which annularly surrounds the interior of the housing 11. The plug seat 20 is held in place by means of a lock-ring 21 of a type known in the art. The plug seat 20 may be designed such that a plug which has been disposed down the central passageway of the well tool will be stopped upon the plug being radially seated upon the plug seat 20. In this configuration, trigger signals are provided by the pressure of the plug against the plug seat 20 as the plug is radially seated upon the plug seat 20.

In an alternative configuration, annular plug seat 20 may not create an impediment to the passage of the plug past plug seat 20. In this configuration, transmission of the trigger signal from the signal generator to the trigger device 19 relies upon proximity of the signal generator within the plug to the trigger device 19 as the plug passes the plug seat 20 within the borehole.

During a cementing operation, the knife gate valve 16 is initially at a closed position, i.e., the cementing port is closed. Tool 10 is placed within a casing string and lowered into position within a bore hole in a manner similar to that shown in FIGS. 3 through 5 of U.S. Pat. No. 3,948,322 issued to Baker (and assigned to Halliburton Company), which is incorporated herein by reference. In order to begin stage cementing through the cementing port, a first plug is disposed downward through the central passageway of the well tool. The signal generator within this first plug provides a trigger signal to the trigger device when the signal generator moves into a position proximate the trigger device 19. Once the trigger signal has been provided, the trigger device 19 actuates the driver assembly 18 to open the knife gate valve 16 and thus permit passage of fluid through the cementing port 15.

Upon completion of the desired cementing placement the port may be closed by disposing a second plug downward through the borehole. When the plug seat encounters the second plug a second trigger signal is provided by the signal generator in the second plug to the trigger device. In response, the drive assembly closes the knife gate valve. With embodiments which employ an electric motor arrangement as a driver assembly, trigger device 19 provides an appropriate electrical signal to the driver assembly 18 to open or close the knife gate valve 16.

It is apparent from FIG. 3 that upon encountering a first plug, trigger device 19 will open solenoid valve 34 to permit fluid flow through tube 31 into portions of cylinder 30 to open knife gate valve 16. Upon encountering a second plug, trigger device 19 must open solenoid valve 35 and permit fluid flow through tube 32 and into portions of cylinder 30 to close knife gate valve 16.

In the preferred embodiments described above, trigger signals are provided to the trigger device 19 by the signal generator when the signal generator has moved into a position proximate trigger device 19 as would occur as a descending plug 61 approaches trigger device 19. In other embodiments, trigger signals are provided to the trigger device 19 by a signal generator which is at a distant location, such as near the wellhead. Numerous techniques for transmitting a signal across such a distance are known in the art. A few of these will now be briefly outlined.

Methods are known in the art for providing such signals from the surface to a subterranean receiver through fluid pressure pulsing within either central passageway 12 or the annulus surrounding the well tool 10. Such techniques are more fully described, for example, in U.S. Pat. Nos. 5,050,675; 4,856,595; 4,971,160 and 4,796,699 issued to Upchurch; and 3,964,556 issued to Gearhart et al., the subject matter of which are incorporated herein by reference.

Acoustic signals may also be provided from the surface to trigger device 19 using a telemetering system similar to that described in U.S. Pat. No. 3,906,435 issued to Lamel et al., also incorporated herein by reference.

Trigger signals may additionally be provided by propagation of electromagnetic waves from a distant location, such as the wellhead. Exemplary methods for providing a distant signal through electromagnetic telemetry systems are described in U.S. Pat. Nos. 4,160,970 issued to Nicolson; 4,087,781 issued to Grossi et al.; 4,785,247 issued to Meador et al.,; 4,617,960 issued to More; 4,578,675 issued to MacLeod; and 4,468,665 issued to Thawley et al., which are also incorporated herein by reference.

In alternative embodiments, the trigger signal may be provided to the downhole trigger device 19 using an electrical signal. A number of suitable techniques are known for providing an electrical signal along portions of the length of a subterranean well. U.S. Pat. No. 4,630,243 issued to MacLeod, which is incorporated herein by reference, described, for instance, a method for establishing a communicative current flow along an electrically conductive drill string. Examples are also provided in U.S. Pat. Nos. 2,379,800 issued to Hare; 4,770,034 issued to Tichener et al.; 4,387,372 issued to Smith et al; 4,496,174 issued to McDonald et al. as well as 4,724,434 and 4,616,702 issued to Hanson et al. each of which are incorporated by reference herein.

The invention has application in multiple stage cementing processes which involve the use of two or more cementers located along the well tool at different depths such that one or more of the cementers is locatable at a higher depth than lowest cementer when the well tool is placed within the borehole. In an exemplary multiple stage cementing operation, valves in the lowest cementer are first opened and closed to controllably flow cement slurry into an adjacent portion of the annulus. Valves in the next highest cementer are then opened and closed to flow cement slurry into an adjacent portion of the annulus above that previously cemented. The operation of opening and closing valves may then be repeated with an even higher cementer.

In accordance with a multiple stage cementing process, a knife gate valve 16 of a higher cementer may be made to open only after the valves of a lower cementer have been opened and closed. A number of techniques may be used to accomplish this result. U.S. Pat. Nos. 4,915,168 and 4,896,722 issued to Upchurch, which are incorporated herein by reference, described exemplary devices for automatically controlling the opening a plurality of valves using a plurality of control systems in response to a stimulus.

Alternatively, the trigger signals may be adapted to control only the knife gate valves 16 for a particular cementer in a multiple stage cementing operation. For example, the trigger device 19 for the lowest cementer may comprise a sensor 51 which is adapted to receive an acoustical signal; the trigger device for higher cementer comprises a sensor adapted to receive a fluid pressure pulse signal. As a result, the valves in the lowest cementer will be opened and closed by acoustical signals generated within descending plugs. Valves in the higher cementer will be opened and closed by fluid pressure pulsing initiated proximate the wellhead.

Any number of such arrangements for providing signals for control of multiple stage knife gate valve cementers may be used. Those skilled in the art will recognize also that, while preferred embodiments of the invention have been described for the purpose of this disclosure, changes in the construction and arrangement of parts may be made which are encompassed by the spirit of the invention in accordance with the following claims.

What is claimed is:

1. A well tool for use in stage cementing a well bore, comprising:

a. a generally cylindrical housing having a central passageway therethrough and an outer cylindrical wall and inner cylindrical wall;

b. a cementing port within said housing adapted to permit fluid communication through said housing;

c. a knife gate valve within said housing, said knife gate valve located between said outer and inner cylindrical walls and being slidable therein between an open position, wherein the cementing port is open, and a closed position, wherein the cementing port is closed.

d. a driver assembly operationally associated with said knife gate valve and which may be actuated to move said knife gate valve between an open position and a closed position.

2. The well tool of claim 1 further comprising a trigger device operationally associated with said driver assembly, said trigger device adapted to receive a trigger signal and actuate the driver assembly in response thereto.

3. The well tool claim 1 wherein said housing further comprises a seal fitting upon the inner cylindrical wall proximate the periphery of said cementing port adapted to assist said knife gate valve in providing a fluid seal across said cementing port when said valve is in a closed position.

4. The well tool of claim 2 wherein said trigger signal is provided by a signal generator disposed within a borehole plug.

5. The well tool of claim 4 wherein the signal generator provides the trigger signal to the trigger device upon said signal generator moving to a position proximate the trigger device.

6. The well tool of claim 4 wherein the signal generator comprises a magnet.

7. The well tool of claim 4 wherein the signal generator comprises a sound generator.

8. The well tool of claim 2 wherein said trigger signal is provided from a distant location.

9. The well tool of claim 8 wherein said trigger signal comprises a fluid pressure pulse.

10. The well tool of claim 8 wherein said trigger signal comprises electromagnetic waves.

11. The well tool of claim 8 wherein said trigger signal comprises an electrical signal.

12. The well tool of claim 8 wherein said trigger signal comprises an acoustical signal.

13. The well tool of claim 2 wherein the trigger device is located within a plug seat which annularly surrounds the interior of said housing and the trigger signal comprises pressure provided by said plug against said plug seat upon the plug being radially seated upon the plug seat.

14. The well tool of claim 1 wherein said knife gate valve presents a substantially flat internal surface toward said inner cylindrical wall.

15. The well tool of claim 1 wherein said knife gate valve presents an internal surface which is radially curved to substantially conform against said inner cylindrical wall.

16. The well tool of claim 2 wherein the driver assembly comprises a pneumatic device.

17. The well tool of claim 2 wherein the driver assembly comprises a hydraulic device.

18. The well tool of claim 2 wherein the driver assembly comprises an electric motor.

19. The well tool of claim 2 wherein the trigger assembly comprises a microprocessor with an associated sensor for receiving trigger signals.

20. The well tool of claim 19 wherein the trigger assembly further comprises an appropriate power supply for operation of the microprocessor and its associated sensor.

* * * * *